United States Patent [19]

Szkaradek

[11] Patent Number: 4,624,418

[45] Date of Patent: Nov. 25, 1986

[54] MEDIA MILL OUTLET ASSEMBLY

[75] Inventor: Edward J. Szkaradek, Santa Ana, Calif.

[73] Assignee: Morehouse Industries, Inc., Fullerton, Calif.

[21] Appl. No.: 746,440

[22] Filed: Jun. 21, 1985

Related U.S. Application Data

[63] Continuation-in-part of Ser. No. 663,049, Oct. 19, 1984, and Ser. No. 627,918, Jul. 5, 1984, abandoned.

[51] Int. Cl.[4] ..... B02C 17/18

[52] U.S. Cl. ..... 241/46.17; 241/69; 241/172

[58] Field of Search ..... 241/172, 46.17, 69; 209/281, 273, 268, 274; 210/488, 435, 437

[56] References Cited

U.S. PATENT DOCUMENTS

| | | | |
|---|---|---|---|
| 3,397,794 | 8/1968 | Toth et al. | 210/488 |
| 3,563,388 | 2/1971 | Briggs | 210/488 X |
| 3,648,843 | 3/1972 | Pearson | 210/488 X |
| 4,146,481 | 3/1979 | Nagatoshi et al. | 210/488 X |
| 4,267,045 | 5/1981 | Hoof | 210/488 X |
| 4,441,658 | 4/1984 | Szkaradek | 241/172 X |

*Primary Examiner*—Mark Rosenbaum

*Attorney, Agent, or Firm*—Knobbe, Martens, Olson & Bear

[57] ABSTRACT

Disclosed is a horizontal media mill comprising a cantilevered shaft extending from a motor into a vessel in which rotor discs mounted on the shaft agitate the grinding media and the product being milled. A cup-shaped screen and a cup-shaped end cover fit over the free end of the rotor and are removably mounted on the end of the vessel. The screen retains the grinding media in the vessel while permitting the milled product to flow therethrough to an outlet in the end cover. The vessel is tiltable towards the screen end to facilitate cleaning and removal of the grinding media or screen elements. The stack of screen elements is radially positioned by ribs on the surrounding housing and axially clamped against lugs by an externally threaded nut. Also disclosed is a similar screen and outlet construction for a vertically oriented sand mill.

23 Claims, 10 Drawing Figures

Fig. 1
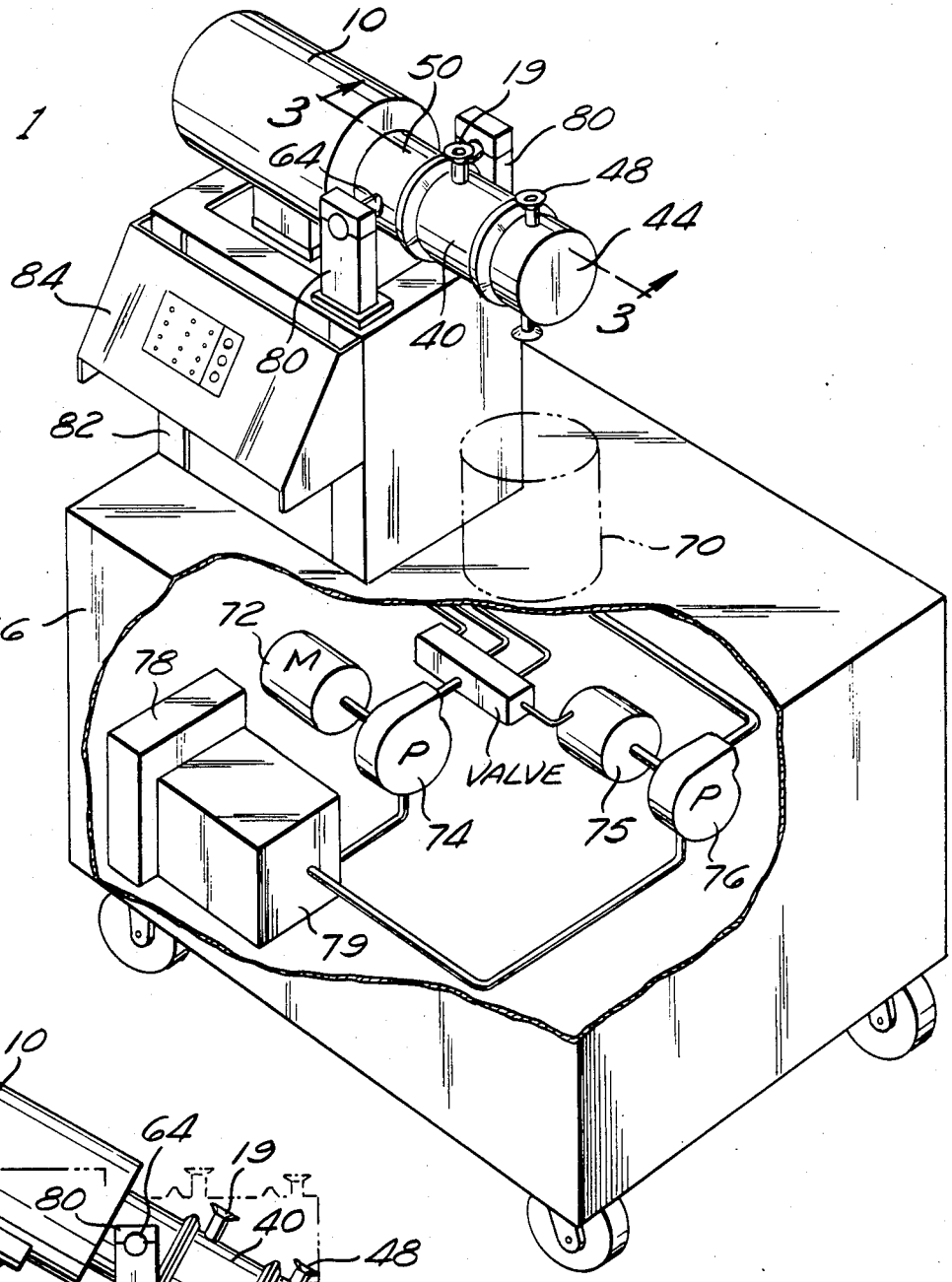
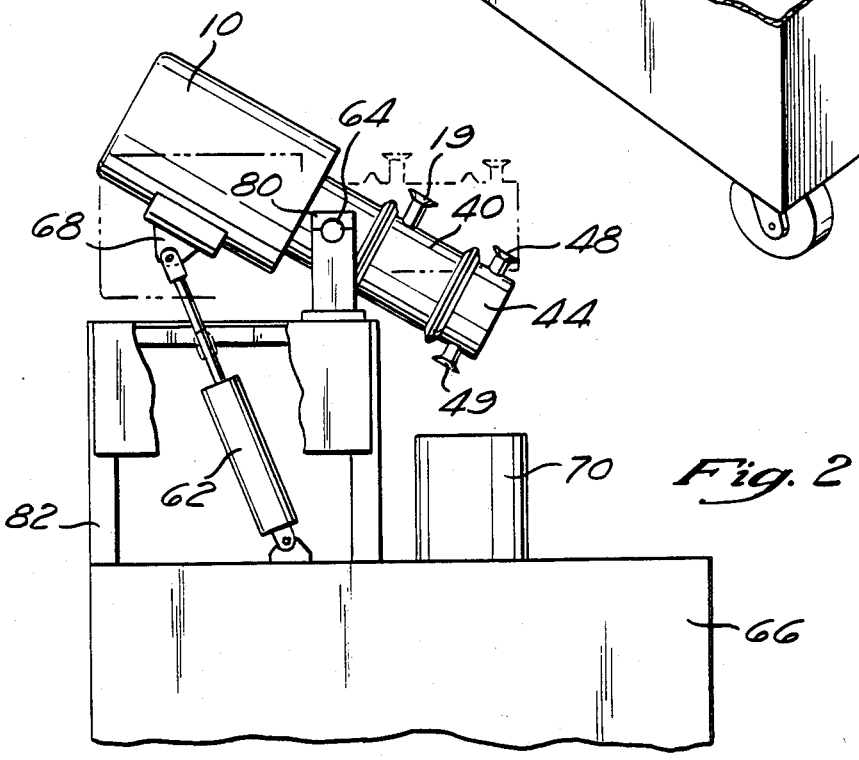
Fig. 2

MEDIA MILL OUTLET ASSEMBLY

RELATED APPLICATIONS

This application is a continuation-in-part of copending U.S. patent application Ser. No. 627,918, filed July 5, 1984, now abandoned and copending U.S. patent application Ser. No. 663,049, filed Oct. 19, 1984.

BACKGROUND OF THE INVENTION

This invention relates to an improved outlet structure for a liquid processing vessel of a small media mill, often referred to as a sand mill. The outlet structure includes an improved screen assembly and the related construction for mounting the screen assembly with respect to the sand mill vessel.

Sand milling is a proven, practical, continuous, high production method of dispersing and milling particles in liquid to produce smooth, uniform, finely dispersed products. Some of the products in which the sand milling process is used includes paints, inks, dye stuffs, paper coatings, chemicals, magnetic tape coatings, insecticides, and other materials in which milling to a high degree of fineness is required.

In a typical sand milling process, the material or slurry to be processed is introduced at one end of the processing chamber or vessel and pumped through a small diameter grinding media while a rotor within the vessel agitates the media to insure proper milling and dispersion of small particles in the liquid or slurry being processed. Although the grinding media in years past was sand, more currently a small manufactured product of steel, glass or other materials is used.

The processed liquid exits from the vessel, but the grinding media must, of course, remain within the vessel. To accomplish this, the outlet structure typically includes a screen assembly which prevents the media from leaving the vessel while the processed liquid flows through the screen. U.S. Pat. No. 4,441,658, issued Apr. 10, 1984 describes a cup-shaped assembly that fits within a cylindrical wall leading to an outlet. The cup shape of the screen assembly provides a large filtering surface area. Other screen assemblies include segments forming a portion of a cylindrical wall. These screen components are typically formed of small diameter rods or strands which are welded at their intersections. A shortcoming of these welded constructions is that the screen become worn causing some of the strands of the screen break or the openings between the strands become large enough to allow passage of the grinding media. This requires early replacement of the screen.

Thus, a need exists for an improved longer lasting screen construction. The screen together with the vessel outlet structure must also be arranged so as to provide easy disassembly and cleaning or replacement of the screen components.

It is also desirable that the screen and outlet construction be sufficiently versatile to be useful for both vertically oriented sand mills and horizontally oriented sand mills. In this connection, there is also a need for periodic removal of the grinding media from the vessel. With vertically oriented vessels, this is accomplished fairly readily by means for a dump valve located at the lower end of the vessel. However, with horizontally oriented vessels the problem is more complex. Since the media lays along the bottom of the horizontal vessel for the entire length of the vessel, removal of the media or access to the screen or rotor has been troublesome.

Prior horizontal mills are typically formed of sections which are bolted together and these sections must be disconnected. To access all of the media, usually results in media spilling out along the entire length of the vessel. To aid in this process, a large pan or tray may be utilized, with the result that the media must again be transferred to another container. The entire operation is messy and time consuming. Thus, a need exists for a simplified horizontal media mill which is easily cleaned and yet is long lasting and durable.

SUMMARY OF THE INVENTION

This invention comprises an improved media mill having a vessel for containing the product to be processed and for containing a small diameter grinding media. A rotor located in the vessel agitates the grinding media as the product to be processed is pumped or otherwise processed through the vessel. To retain the media within the vessel while permitting the processed liquid to flow out of the vessel, there is provided an improved screen and outlet construction. This includes a cylindrical housing wall and a plurality of flat rings which are positioned within the cylindrical wall to form an annular stack. The cylindrical exterior of the stack is spaced inwardly from the surrounding cylindrical wall to define an annular passage. The screen elements form an interior cylindrical space. An end plate positioned on one end of the stack of screen elements closes one end of the cylindrical space.

A plurality of the screen elements have openings which connect the annular passage surrounding the screen elements with the cylindrical space within the elements. Preferably, the openings are formed by flat grooves or channels formed in an end face of the elements such that the face of the confronting or adjacent element cooperates with the grooves to form a wall of the opening. These openings include a dimension smaller than the grinding media so that the grinding media cannot pass into such openings, whereas the processed liquid can flow therethrough. The openings are substantially straight and direct through the screen elements so as to minimize any pressure drop across the openings. Preferably, one end of the cylindrical wall includes an outlet through which the liquid product flows after it has passed through the screen assembly. The screen elements are clamped within the cylindrical housing so that the assembly can be readily disconnected and the screen elements replaced or cleaned. However, due to the radial thickness of the screen elements essentially eliminate the need for replacement from a wear standpoint. However, they may be readily replaced in the event a media of different size is to be used such that the openings through the screen element should be coordinated therewith.

In a preferred construction there are provided three or more ribs extending inwardly from the cylindrical wall to position the screen elements spaced from the wall. Also, a plurality of lugs are provided which extend radially inwardly further than the ribs to be engaged by the end plate. A suitable clamp or retainer in the form of an annular member having a threaded exterior is threaded into one end of the cylindrical wall to clamp the screen elements and the end plate against the lugs. This simple approach makes the screen elements easy to assemble and disassemble.

In one form of the invention, the stack of screen elements is positioned so that the cylindrical space within the elements is open to the liquid being processed in the vessel and to the grinding media, and the end plate of the construction is positioned close to but spaced from the outlet end wall. This outlet end wall may conveniently be formed integral with the cylindrical wall so that a cup-shaped housing is provided. The lugs positioning the end plate may likewise be formed integral with the cylindrical side wall and with the end wall. The lugs space the end plate from the end wall and thus place the annular passage surrounding the screen elements in communication with the liquid outlet. With this arrangement, the liquid passes radially outwardly through the screen openings into the annular passage and then to the liquid outlet, while the grinding media is retained within the vessel and the cylindrical space within the screen assembly. The cup-shaped housing may conveniently be formed with an outwardly-extending flange which mates with a flange on the sand mill vessel such that the screen outlet housing may be quickly connected or disconnected to the vessel flange by means of a quick/disconnect clamp ring.

The arrangement described in the preceding paragraph is particularly advantageous in connection with a horizontally oriented sand mill. In this approach, the screen assembly essentially forms an extension of the sand mill vessel with the rotor within the vessel extending into the screen assembly. The rugged construction of the screen assembly is such that it can withstand the abrasive action of the grinding media directly adjacent to the moving rotor. Moreover, the wearing of the interior wall of the screen elements caused by the abrasive grinding media, does not increase the screen size of the openings through the screen assembly, so that media continues to be prevented from passing into such openings.

Another significant advantage of this outlet construction in connection with the horizontally oriented sand mill is that by providing the mill with means for tilting the vessel so that the outlet end is lower than the opposite end, the grinding media may be easily removed from the mill by simply removing the outlet housing on the vessel lower end. This allows the grinding media to fall into a suitable receptacle. Further, the screen elements are then readily accessible and removable from the housing for cleaning or replacement if such is desired.

In a vertically oriented sand mill, the outlet is typically oriented transversely with respect to the axis of the vessel. An opening in the exterior wall of the vessel near its upper end may however be provided with a suitable flange for mating with the flange of a screen outlet housing of the type discussed above in connection with the horizontal sand mill. However, as an alterntive and preferable arrangement for a vertically oriented sand mill, the flow through the screen elements may be reversed. With this approach, a cylindrical outlet housing wall is preferably formed integral with the upper portion of the vessel, with the cylindrical outlet wall extending generally transverse to the axis of the vessel. The screen assembly stack is reversed so that the end plate is located at the end closest to the vessel rotor. The lugs for positioning the end plate extend inwardly from the cylindrical housing wall adjacent the vessel and the positioning ribs are still formed integral with the side wall of the cylindrical housing so that the annular passage surrounding the screen elements is in direct communication with the vessel. The opposite end of the stack of screen elements is open to an outlet in a cover secured to the outer end of the cylindrical housing. Consequently, the product flow through the screen is into the annular passage and then radially inwardly through the screen openings into the cylindrical space within the elements and then directly through an outlet in the end cover. The screen elements are compressed or held against the end plate and the positioning lugs by an annular member which threads into the outer end of the cylindrical wall, adjacent the cover.

The openings formed in the screen elements are preferably made by a cutting or grinding operation directly across one face of the annular element so that a pair of grooves channels are formed on the face of the element diametrically opposite from each other. A second cut 90° from the first is then made across the face of the element to form a second pair of wide diametrically spaced grooves. This creates four wide openings separated by wedge-shaped segments or pads that receive the axial or compressive force on the stack of screen elements. With such an approach, the width of the slots openings through the screen elements remains constant. Thus, it does not matter from a function standpoint whether the flow is inwardly through the screen elements or radially outwardly.

BRIEF DESCRIPTION OF THE DRAWINGS

FIG. 1 is a perspective view of a horizontal sand mill on a rolling base;

FIG. 2 is a side elevation showing the mill of FIG. 1 in a tilted position;

DETAILED DESCRIPTION OF THE PREFERRED EMBODIMENT

Figure 3:
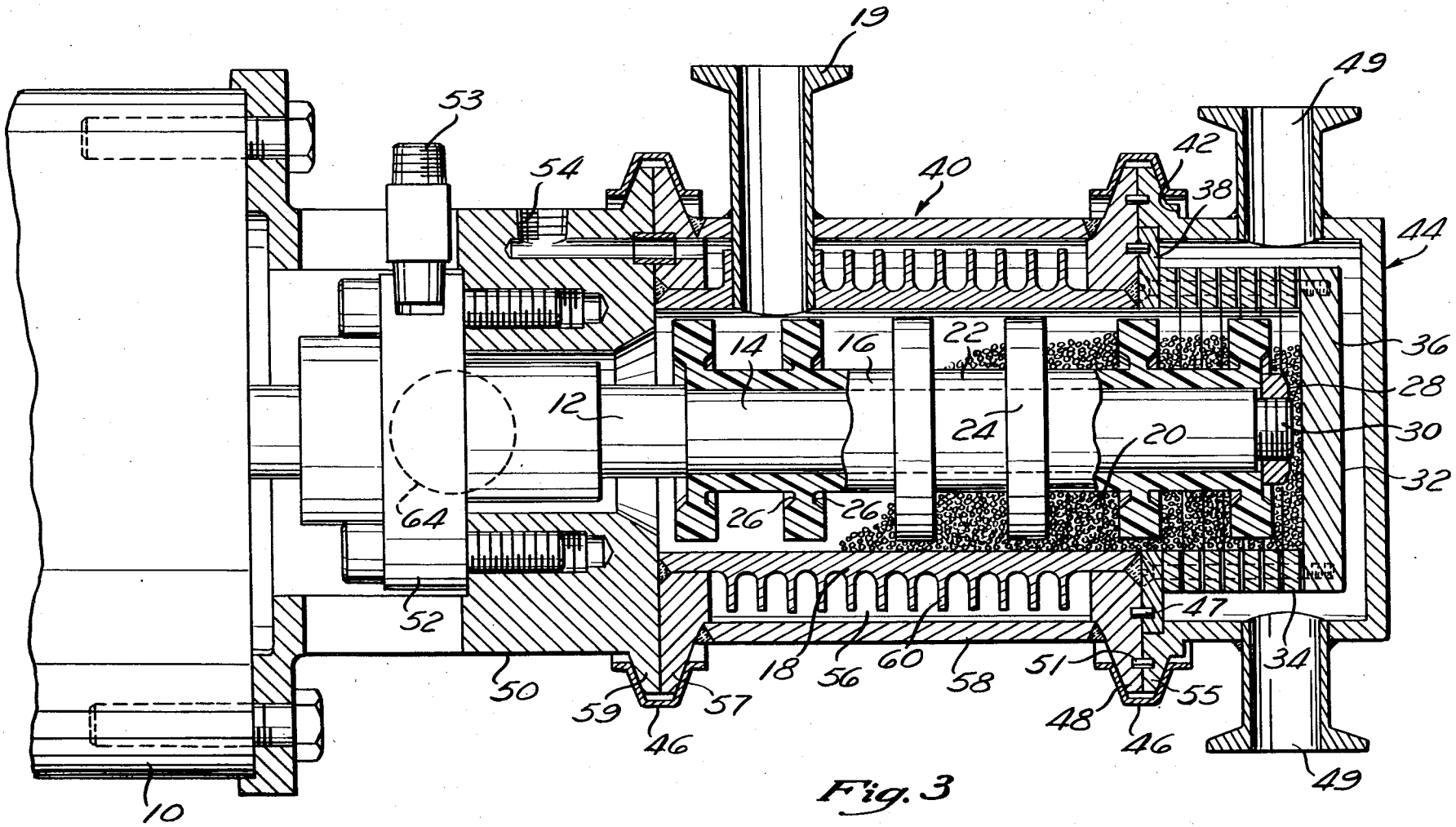
FIG. 3 is a cross-sectional view of the mill on line 3—3 of FIG. 1.

Shown in FIG. 3 is a horizontal media mill comprising a mill motor 10 which has a shaft 12 which rotates a rotor 16. Preferably, the shaft 12 which drives the rotor 16 extends cantilevered directly from the mill motor 10. The portion 14 of the shaft 12 on which the rotor 16 is slideably mounted is preferably square in transverse cross section to mate with a similar opening in the rotor to prevent rotational slippage of the rotor 16. Alternatively, the shaft portion 14 and thr rotor may be any symmetrical shape which has a straight portion to prevent slippage, or the rotor 16 may be keyed to the shaft 12. The rotor 16 extends through a cylindrical vessel 18, in which media 20 and product are agitated by the rotor 16. Product is introduced to the vessel through product inlet 19 at the motor end of the vessel.

The rotor 16 is preferably fabricated from a wear resistant polymer, and is machined from a solid bar of the polymer. One suitable polymer which is abrasively tougher than steel is an ultra high molecular weight polyethylene. In accordance with one feature of the invention, the fabrication process consists of drilling a pilot hole axially through the center of the bar, and then broaching a square hole through the center of the bar, surrounding the pilot hole. Alternatively, fabrication may begin with a tube of the polymer so that the first step is broaching the square cross section in the center hole of the tube. Next, the piece is turned on a lathe to be trimmed into a cylinder of a desired outside diameter. The cylinder is then cut radially to form a smaller diameter cylindrical portion 22 with a series of axially spaced, annular discs 24 which are integral with and surround the cylindrical portion 22. Finally, each disc 24 is undercut on both axial faces to create annular grooves 26 in the area where the discs 24 join the cylindrical portion 22.

The rotor is slideably mounted on the square portion 14 of the shaft 12, and is simply secured in place by a nut 28 screwed on a threaded portion 30 on the end of the shaft 12. The nut 28 is of sufficient diameter to abut the end of the rotor, so that it does not slide off the shaft.

The shaft and rotor protrude through the open end of the vessel 18, which is enclosed by a screen assembly 32. The open end of the vessel is opposite the end of the vessel adjacent the product inlet 19. The screen assembly 32 is cup-shaped, and includes a tubular screen unit 34, a circular end plate 36, and an annular flange 38 on the open opposite end. The milled product can pass through the screen unit 34 while the media is retained in the vessel. The screen assembly 32 is aligned and temporarily supported on the vessel assembly 40 by means of a plurality of dowel pins 47 positioned in the screen flange 38 and a large annular flange 48 secured to the vessel and a surrounding cylindrical outer shell 58. A cup-shaped end cover assembly 44 encloses the screen assembly 32 and is mounted to the vessel assembly 40 with a retainer ring 46 which surrounds and clamps together with a flange 55 on the cover assembly which mates with flange 48 of the vessel assembly. The end cover assembly is also retained in engagement with the vessel assembly flange 48 by dowel pins 51 in mating holes in the flanges 48 and 55.

The cover flange 55 includes a shoulder 42 which more positively holes the screen flange 38 in engagement with the vessel flange 48.

The retainer ring 46 consists of a circular ring which is split in at least one place to enable expansion, and which is fastened together at those splits by a quickly releasable fastening means, not shown. In a preferred embodiment, the retainer ring 46 is fastened by a clamp of the general type shown in the above-referenced U.S. Pat. No. 4,140,283.

The end cover assembly 40 includes a pair of diametrically spaced, upper and lower product outlets 49, through which the milled product filtering through the screen element 34 can flow.

In the arrangement illustrated, the screen unit forms a tubular portion of the screen assembly, and is bolted at one end to the screen flange 38 and at the other end to the circular end plate 36. The screen unit comprises a plurality of rings or annular discs 35, each having a central opening and a pair of opposed faces. The discs are stacked with the central openings aligned to form a tube or cylinder having a central axial space. This space surrounds a portion of the rotor which protrudes through the vessel. The opposed faces form a plurality of radial openings in the cylinder between adjacent discs to allow the passage of processed liquid from the vessel, or central axial opening, to the outside of the cylinder. The smallest dimension of each radial passage is small enough to prevent flow of the grinding media through the passage, so only liquid product leaves the vessel.

The vessel assembly is also removably mounted at its inlet end to a housing assembly 50 which is bolted to the mill motor 10 at one end and is coupled to the vessel assembly at the other end, encasing the shaft 12 throughout its length. Quickly removable retainer ring 46 clamps the radially extending flange 57 of the vessel assembly to the flange 59 of the housing assembly 50.

The mill further includes an integrated hydraulic system having a single electric motor 72 which drives a circulating pump 74; the working fluid pressurized by that circulating pump being utilized to cool the vessel, provide pressure to a seal 52, drive a hydraulic motor 75 which rotates a product pump 76, and hydraulically tilt the mill when it is to be cleaned. The motor 72, circulating pump 74, motor 75, and product pump 76 are located within the base 66, as schematically shown in FIG. 1.

The vessel is sealed from the exterior by the pressure seal 52 which is a cartridge that is bolted to the housing assembly 50 and surrounds the shaft 12. Pressurized working fluid is pumped into the seal 52 through a seal inlet 53 to provide a pressure greater than that on the vessel side of the seal and thus prevent leakage out of the vessel. This enables the product to be pumped through the vessel at a desired pressure and flow rate.

Pressurized fluid also acts as a coolant for the vessel by being circulated through a cooling jacket inlet 54 and into the cooling jacket 56 defined by the outer wall of the vessel 18 and the surrounding cylindrical outer shell 58. The vessel has a plurality of fins 60 protruding radially into the cooling jacket 56 to facilitate the transfer of friction generated heat within the vessel to the coolant. Not shown is a cooling jacket outlet, through which the coolant is returned to a heat exchanger 78 where it is circulated and cooled itself by cooling water, before being returned to a reservoir 77.

The pressurized working fluid from the pump 74 is also used to power a hydraulic motor 75 driving a product pump 76, which pumps the product through the vessel, thus eliminating the need for a separate electric product pump motor and associated explosion-proof switch.

The fluid also powers the hydraulic ram 62 shown in FIG. 2, which extends to tilt the mill about a trunion 64, facilitating the cleaning of the vessel. A horizontal mill having a cantilevered shaft, as shown, is particularly suited for this tilting application. FIG. 1 shows the mill in its normal horizontal operating state, and FIG. 2 shows the mill in its tilted position. Two mounts 80 extend from the superstructure 82, on either side of the housing assembly 50. The trunions 64 are fixed to and protrude radially outward from the sides of the housing assembly, and pivotably rest within circular holes in the mounts 80. The hydraulic ram 62 is located within the superstructure 82, and is pivotably secured to the base 66, at one end, and is pivotably secured to a motor mounting plate 68 at the other end. The motor mounting plate 68 is fastened to the mill motor 10.

Both the electric motor powering the hydraulic system and the electric mill motor are regulated by a pneumatic control system (not shown), which runs on compressed shop air. A suitable control panel 84 for controlling the operation of the system is conveniently supported on the superstructure 82. The pneumatic system saves the expense of explosion-proof electrical switches which must be used when a flammable product is being milled.

In operation, a liquid product or slurry is pumped by the hydraulically driven product pump 76 through the product inlet 19 to the vessel 18 and is dispersed throughout the grinding media 20 by the rotating rotor 16. In a small working version of the present embodiment, a single speed, 3600 rpm electric mill motor turns $2\frac{3}{4}$ inch diameter rotor discs 24 at a rim speed of 2590 ft./min. The milled product filters through the screen unit 34 to the product outlet 49. Simultaneously, the vessel is being cooled by the working fluid which is circulating through the cooling jacket 56. The working fluid provides pressure to the seal 52 surrounding the shaft 12 where it enters the vessel.

When the vessel is to be cleaned, the mill is tilted about the trunion 64 by the extension of the hydraulic ram 62, lowering the outlet end of the vessel. The end cover assembly and screen mounting assembly are then quickly removed from the vessel assembly by first unfastening the retainer ring. The pins 47 and 51 prevent the end cover and screen assemblies from both instantly falling off. To uncouple the assemblies, an axial pull on the end cover, and then the screen assembly, will dislodge the pins from their corresponding holes. The angle of the mill allows the media to conveniently drain out the then open end of the vessel, and into a suitable container 70. With the end cover and the screen assembly uncoupled, the rotor is easily withdrawn by removing the nut 28 from the threaded portion 30, sliding the rotor off the shaft to be replaced or simply temporarily removed to enable more complete access to the vessel for cleaning. The steps are reversed when the rotor is installed and the screen and end cover re-installed, and the unit returned to its horizontal position.

The grinding media is usually added through the product inlet 19, but it may also be added through the open end of the vessel when its screen is removed. In this regard, the ram 62 may be useful in tilting the vessel to distribute media. The unit may be designed to lower the motor end of the vessel slightly, if desired.

Figure 4:
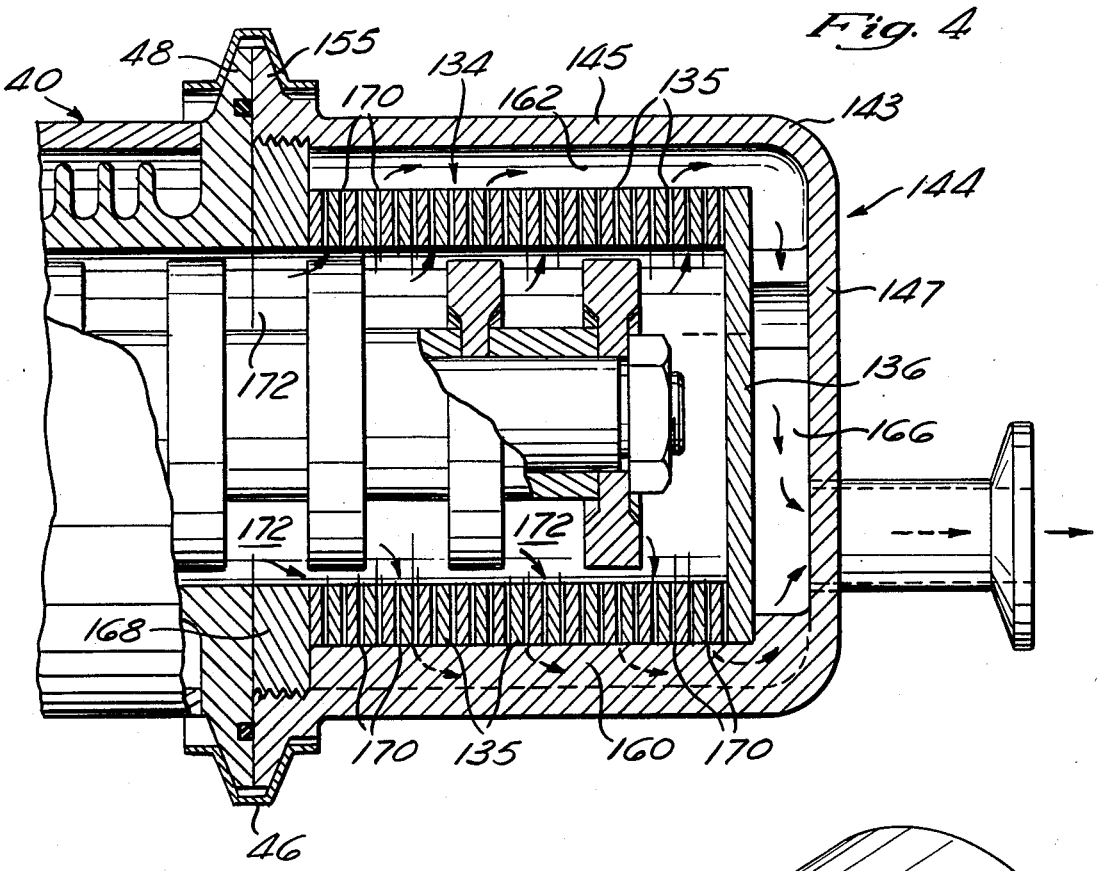
FIG. 4 is a cross-sectional view of a preferred form of the screen assembly and outlet construction for a mill of the type illustrated in FIGS. 1–3.
Figure 5:
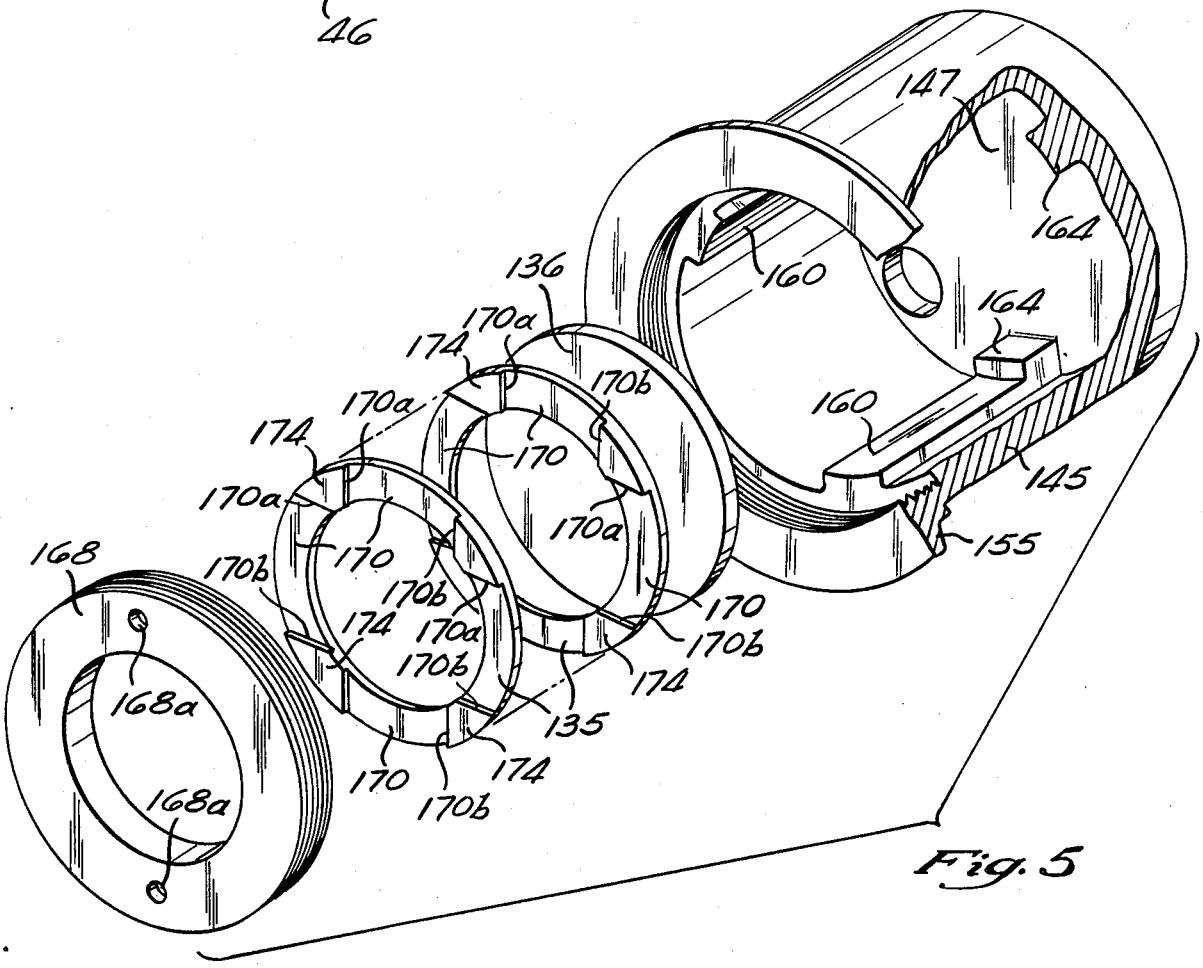
FIG. 5 is an explosed, perspective, partially cut-away view of the screen and outlet construction of the arrangement in FIG. 4.

While the screen assembly illustrated in FIG. 3 employing a plurality of bolts holding the screen elements in place is useful, FIGS. 4 and 5 illustrate a much preferred construction. This includes a cup-shaped end cover assembly or outlet construction 144, having a housing 143 with a cylindrical wall 145 and an integral end wall 147. An outwardly-extending flange 155 is formed on the open end of the cylindrical wall and mates with a large annular flange 48 formed on the open end of the sand mill vessel 18. A cylindrical or tubular screen 134 is formed by a plurality of ring-shaped elements or disks 135 positioned within the cylindrical wall 145. More specifically, these screen elements 135 are positioned or spaced inwardly from the cylindrical wall 145 by three ribs 160 which extend radially inwardly and extend axially throughout the length of the stack of screen elements 135. Preferably the ribs 160 are formed integral with the wall 145 such that the entire cup-shaped housing may be cast and the ribs than machined on their inner edge to provide the desired diameter for positioning the screen elements in alignment. The ribs 160 space the screen elements 135 from the cylindrical 145 so as to form an annular passage 162 interrupted only by the ribs.

A closed end plate 136 is located on the downstream end of the stack of screen elements, being radially positioned by the ribs 160. The end plate is further confined by three lugs 164 which form axial extensions of ribs 160 but extend radially inwardly further than the ribs to provide surfaces that engage the outer axial face of the end plate 136 at three circumferentially spaced locations, as may be visualized from FIGS. 4 and 5. The lugs 164 space the end plate 136 from the housing end wall 147 so as to form a disk shaped space 166 which is in communication with the annular space 162 through arcuate windows between the lugs 164. The stack formed by the screen elements and the end plate 136 is axially pressed or held against the lugs 164 by means of a ring-shaped member forming a clamp or threaded fastener 168. The member 168 has an internal diameter equal to the internal diameter of the screen elements and the vessel. The external diameter of the member 168 is threaded to thread into mating threads formed on the interior cylindrical wall 145 adjacent the open end of the housing, radially aligned with the flange 155. The fastener member 168 is readily rotatable by use of a pair of sockets 168*a* formed on the outer face as shown in FIG. 5.

Figure 9:
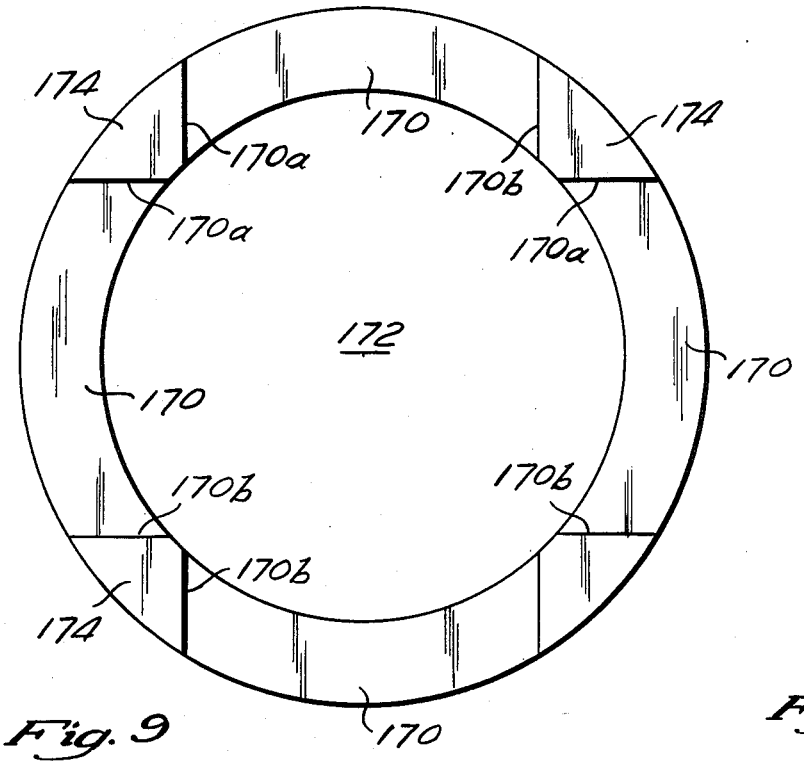
FIG. 9 is a plan view of one screen element.
Figure 10:
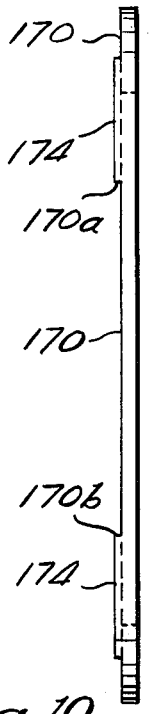
FIG. 10 is a side view of the screen.

A plurality of openings 170 are formed between each adjacent pair of screen elements 135 connecting the cylindrical interior space 172 within the screen assembly with the annular passage 162 surrounding the screen elements. As may be seen from FIGS. 5 and 9, the openings 170 are in the form of shallow cuts or grooves made in one axial face of each screen element. Preferably four grooves are made in each element, with such grooves having side walls 170*a* and *b* which are parallel to each other. That is, they are non-radial. With such an arrangement, the cross-section of each opening 170 is constant. As can be seen from FIG. 5 and FIG. 9, the axial depth of each cut or opening is very small. It is sized to prevent grinding media from moving into the opening. With the axial dimension preventing the media from entering the opening, the circumferential or lateral dimension of a slot is not critical, although it is preferable that they be as wide as possible, consistent with other design requirements. This is important since the combined area of the screen openings should be greater than the inlet area to the mill so that the screen does not produce a restriction.

Related to this, it should be noted that the straight sided cuts and wide openings minimize any pressure drop across the screen elements also, any broken or worn media particles that should enter a screen opening 170 are not trapped in the screen openings, and thus do not cause clogging of the screen. The purpose of the screen is to keep media in the mill, and not to capture particles in the screen passages.

Advantageously, the opening 70 may be formed by cuts which are machined into the face of the screen element by relative movement of a mill cutter and the element directly across the element. A similar cut can then be made 90° with respect to the first cut to form the other pair of diametrically spaced openings. This leaves four arcuately-spaced, wedge-shaped pads or segments 174. These pads 174 receive the axial load when the screen elements 135 are clamped within the housing by the threaded fastener 168. When installing this screen element into the housing, the pads 174 are preferable placed into axial alignment; however, it should be noted that the screen elements are sufficiently rugged that alignment is not critical. Thus, the screen elements may be quickly installed and positioned by the ribs 160 without critical concern for angular orientation.

The screen elements may be made of varying thicknesses, as strength and other design requirements dictate. Likewise, the screen elements may be made of any desired material, such as stainless steel or an abrasive-resistant polymer material. The axial depth of the slots or openings 170 is, of course, to be consistent with the size of the media to be utilized in the mill. Further, as mentioned above, screen elements of different slot depths may be utilized for different media size, and the screen assembly design is such that a stack of elements may be quickly and conveniently replaced by a different stack as needed. Of course, the removed stack can be reused at a later time if the media is to be changed again.

Figure 8:
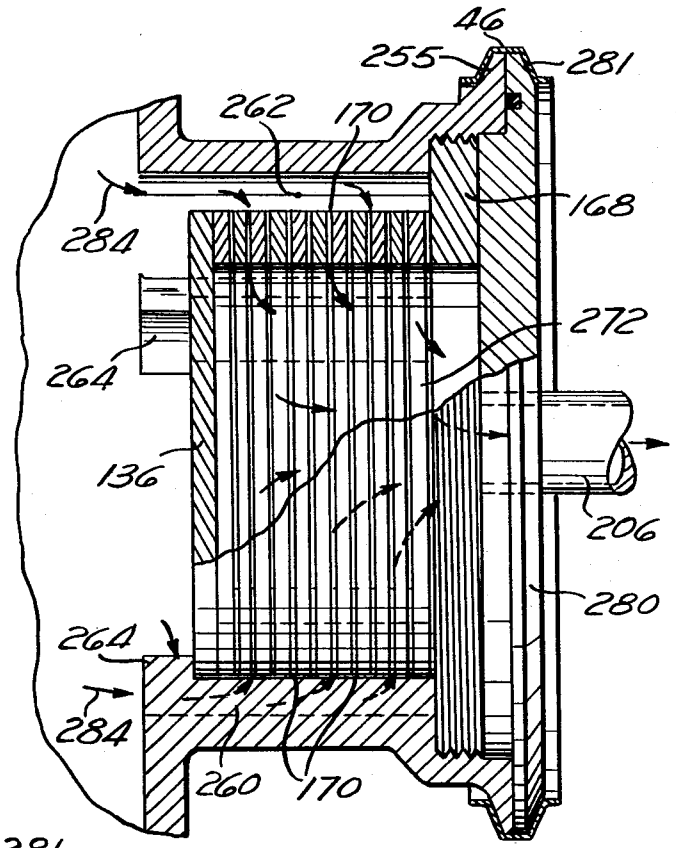
FIG. 8 is a cross-sectional view of the outlet construction of the arrangement FIGS. 6 and 7.
Figure 6:
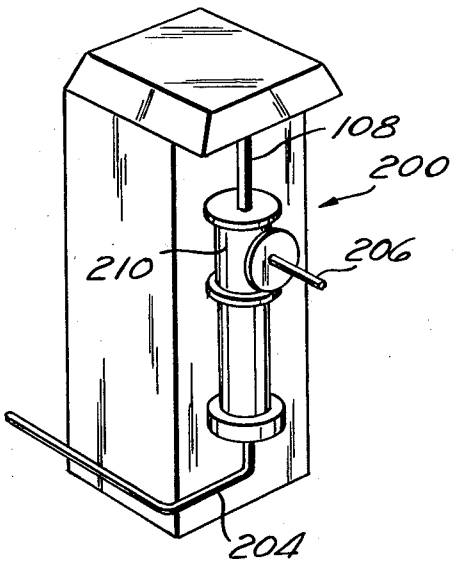
FIG. 6 is a perspective, schematic view of a sand mill having a vertically oriented vessel.
Figure 7:
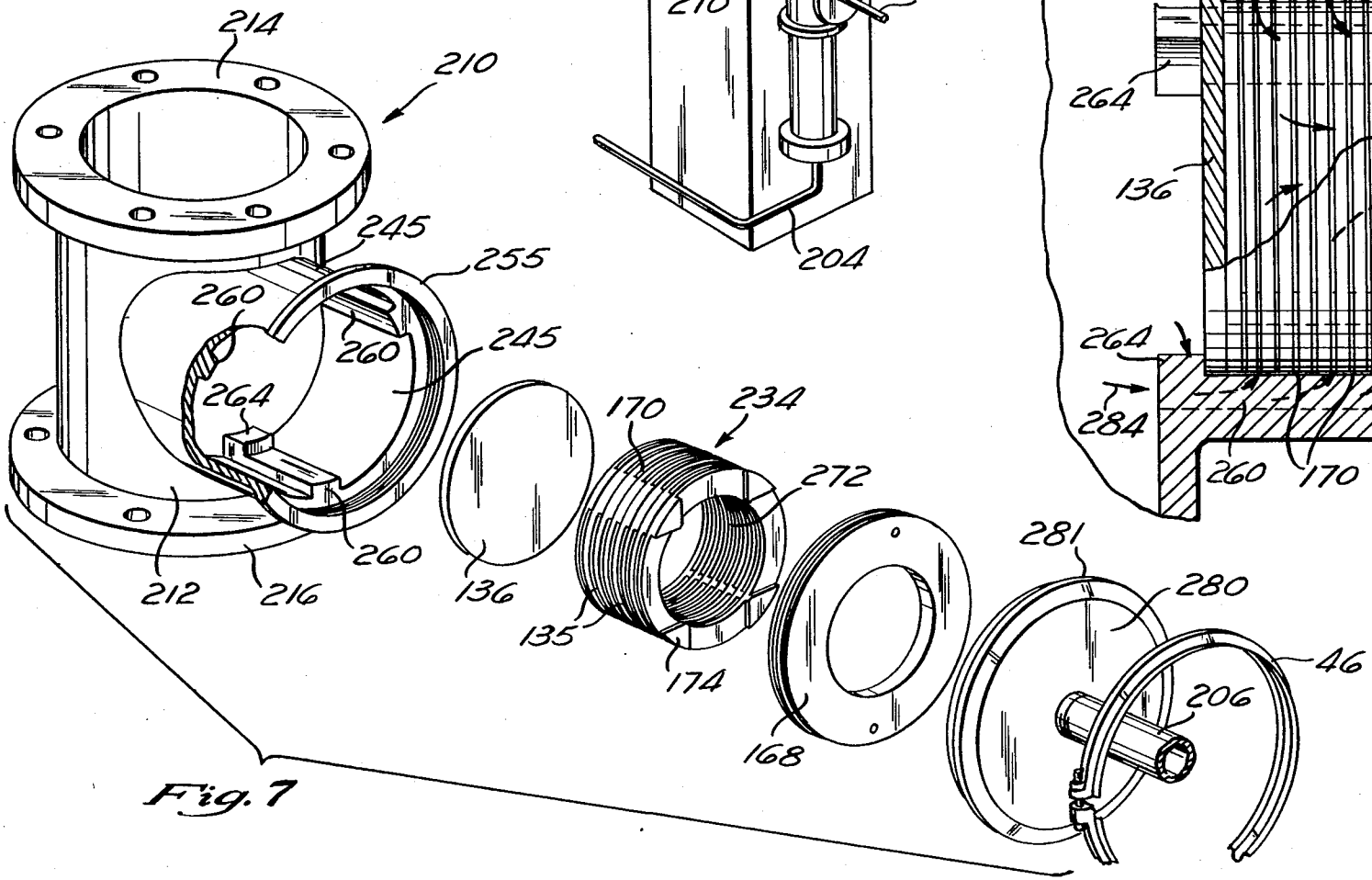
FIG. 7 is an exploded, perspective view of the sand mill of FIG. 6, illustrating the screen assembly and outlet construction.

Turning now to FIGS. 6, 7, and 8, there is substantially illustrated a vertical sand mill 200 having a vertically oriented vessel 202 with a product inlet 204 at the lower end and a product outlet 206 near the upper end. A rotor (not shown) is vertically mounted in the vessel with the rotor shaft extending upwardly out of the upper end of the vessel through a tubular sleeve 108. A rotor similar to that shown in the arrangement of FIG. 3, or any well-known prior art rotor, may be utilized.

The upper end of the vessel and an outlet structure for the vessel includes a generally T-shaped casting 210 having a vertically oriented cylindrical portion 212 which forms a part of the vessel 202 and a generally horizontal portion forming an outlet housing 245. The vertical portion 212 includes upper and lower flanges 214 and 216 for convenient connection to the remainder of the vessel. As can be seen from FIGS. 7 and 8, the interior cylindrical wall 245 is formed with three axially extending ribs 260. At the vessel end of the ribs, there is provided three lugs 264 which are axially aligned with the ribs but extend radially inwardly further to form axial support surfaces for an end plate 136 and a plurality of screen elements 135 that form a screen assembly 234. The end plate and the stack of screen elements are clamped or held against the lugs by means of an externally threaded annular fastener 168 which threads into mating threads formed in the open outer end of the housing 245. A cover plate 280 closes the outer open end of the screen assembly 234 and an outer peripheral flange 281 of the cover plate mates with a similar flange 255 formed on the open outer end of the cylindrical wall 245. These flanges are held in place by a suitable quick connect/disconnect clamp arrangement 46 as described above.

The ribs 260 space the screen elements 135 radially inwardly from the outer cylindrical wall 245 creating an annular passage 262 which is in direct communication with the sand mill vessel. Thus the product can flow axially into this passage, radially inwardly, as indicated by the arrows 284 shown in FIG. 8, through the openings 170 into the cylindrical space 272, and then flows axially through an outlet 206 in the cover plate.

The flow through the screen assembly of FIGS. 7 and 8 is thus just the opposite from that shown for the assembly in FIGS. 4 and 5. Nevertheless, the flow characteristics remain the same for the two approaches in view of the constant cross section of the openings 170 through the screen assembly. Thus the same screen elements can be used in either approach, and additional design need not be conducted.

Although with the arrangement shown in FIGS. 7 and 8, the entire housing surrounding the screen elements is not removable, the screen elements may nevertheless be easily removed or installed by simply removing the quick disconnect coupling, unthreading the fastener 168 and removing the screen elements as well as the end plate, as desired. Of course, if desired, a flange could be positioned at the vessel end of the housing so that an arrangement essentially like that shown in FIG. 4 could be employed in the vertically oriented housing as well.

I claim:.

1. Milling apparatus comprising:

a generally cylindrical vessel for receiving grinding media and a liquid having small particles therein which are to be milled or reduced in size within the vessel;

a motor driven rotor in the vessel for agitating the grinding media;

a liquid inlet through which said liquid is introduced as the grinding media is agitated by the rotor;

a liquid outlet section for said vessel including a generally cup-shaped housing having a cylindrical side wall and an end wall;

a plurality of ring-shaped screen elements arranged in a stack within said cylindrical wall defining a cylindrical space;

structure attached to said housing for spacing the periphery of the screen elements from said cylindrical wall to define an annular passage;

means for axially holding said stack within said housing;

said screen elements having slots formed in their axial faces so that the slots and the adjacent screen elements define openings extending between said annular passage and said cylindrical space, said openings being sized to prevent the grinding media from passing into the openings, and said openings being relatively straight and direct to minimize pressure drop across the opening and to minimize clogging of said openings by media particles or product; and an outlet in said housing through which the liquid may exit from the vessel after passing through said screen openings.

2. The apparatus of claim 1 wherein said stack includes an end plate on the end of said stack adjacent said end wall, with said end plate being spaced from said end wall to provide an end passage which is in communication with the downstream end of said annular passage, said outlet being in said end wall and in communication with said end passage, and the opposite end of said stack of elements is in open communication with said vessel while said annular passage is closed to said vessel except through said screen openings whereby the liquid flow through the screen openings is from said cylindrical space within the screen elements and radially outwardly through said openings into said annular passage.

3. The apparatus of claim 2 wherein said cylindrical wall is connected directly to an end of said vessel such that the screen elements in combination with said cylindrical wall essentially form the end of the vessel.

4. The apparatus of claim 3 wherein said axial holding means includes an annular fastener which is externally threaded and threads into the end of said cylindrical wall joined to said vessel, and a plurality of lugs adjacent said end wall having support surfaces spaced from the end wall and the portion of the cylindrical wall joining the end wall, the fastener clamping said stack against said lugs.

5. The apparatus of claim 1 wherein said cylindrical wall extends generally transversely to the vessel with said stack including an end plate on the end facing the vessel and with said end plate being spaced from the cylindrical wall such that said annular passage is in open communication with said vessel, the opposite end of said stack of screen elements being open to said outlet in said end wall, said outlet being in said end wall so that the liquid flow through said screen openings is from said annular passage and radially inwardly through the openings into the cylindrical interior space of said screen elements to said outlet.

6. The apparatus of claim 5 wherein said holding means includes inwardly extending lugs adjacent the vessel end of the cylindrical wall, said lugs being engaged by said end plate to axially position the screen elements in the cylindrical wall, and said cylindrical wall including inwardly extending ribs which radially position said end plate and said screen elements.

7. The apparatus of claim 6 wherein said holding means further includes an annular fastener which threads into the outer end of said cylindrical wall to hold the screen elements and end plate against said lugs.

8. The apparatus of claim 7 including an end cap having an outlet therein which cooperates with said housing and said fastener to close the end of said screen assembly.

9. The apparatus of claim 8 wherein said housing includes an outwardly extending flange on its outer end, and said end cap includes a flange which cooperates with said housing flange, and including a quick disconnect clamp ring which cooperates with said flanges to hold the end cap onto said housing.

10. The apparatus of claim 1 wherein said screen elements have a plurality of radially extending grooves separated by pads which provide the structure for holding said openings open when the stack of screen elements are clamped within said housing.

11. The apparatus of claim 10 wherein said openings include at least one pair of diametrically opposite openings with straight transversely aligned edges.

12. The apparatus of claim 1 wherein said structure includes a pluarlity of ribs extending radially inwardly from said side wall.

13. The apparatus of claim 12 wherein said holding means includes a plurality of lugs extending radially inwardly from said side wall further than said ribs to provide axial surfaces engaged by said plate.

14. The apparatus of claim 13 wherein said holding means further includes a clamping member for clamping said elements and said plate against said lug surfaces.

15. The apparatus of Claim 1 wherein said screen assembly surrounds an end of said rotor to form an end of said vessel with said housing.

16. Milling apparatus comprising a vessel for containing a product to be milled and a grinding media, a rotor in said vessel for agitating the product and the media as the product moves through the vessel, and an outlet screen assembly which permits product to exit from the vessel while preventing the media from exiting from the vessel, said screen assembly including a housing having an inner side wall, a plurality of ribs extending radially inwardly from said side wall, a plurality of ring-shaped screen elements stacked in said housing radially positioned by said ribs and spaced from said side wall to define a fluid passage between the exterior of the elements and said side wall, a plurality of circumferentially spaced lugs on the interior of said housing extending radially inwardly further than said ribs to provide an axial stop for said stack, fastener means cooperating with said housing for holding said stack of elements against said lugs and thereby hold the elements within the housing, the means defining a plurality of openings extending generally radially through said screen elements, said openings being sized to prevent the grinding media from flowing into them while permitting the product to flow therethrough, and means defining an outlet downstream from said radial openings.

17. The apparatus of claim 16 wherein said clamp means comprises a ring-shaped fastener which is externally threaded to thread into mating threads on the interior wall of said housing.

18. The apparatus of claim 16 wherein the inner diameter of said fastener is approximately equal to the inner diameter of said screen element.

19. The apparatus of claim 16 wherein said housing includes an end wall having an outlet therein which forms the product outlet for the vessel, said stack includes a plate on one end, said lugs are positioned adjacent said end wall and said end plate is positioned by said lugs spaced from said housing end wall, said fastener closes the upstream end of said fluid passage, and said screen assembly is oriented so that the product flows axially into said screen assembly, radially outwardly through said screen element into said fluid passage and between the end plate and the housing end wall, to said outlet.

20. The apparatus of claim 21 wherein said housing includes an outwardly extending flange on one end into which said fastener is threaded, said vessel having an opening therein surrounded by a flange which mates with said housing flange, and including quick disconnect clamp means cooperating with said flanges to connect the housing to the vessel.

21. The apparatus of claim 20 wherein a portion of said rotor extends into the interior of said screen elements such that said screen elements and said housing in effect form an outlet end of said vessel.

22. The apparatus of claim 16 wherein said vessel is vertically oriented and said housing extends generally transversely and is connected to the vessel to form an outlet for the vessel.

23. The apparatus of claim 22 wherein said lugs are located at the end of the housing adjacent said vessel such that the end plate faces the vessel and closes the vessel end of the screen elements while the periphery of the end plate and the periphery of the screen elements form an annular flow passage leading from the vessel whereby the product flows radially inwardly through the screen elements and exits axially through the fastener to said outlet.

* * * * *